United States Patent [19]

Kamikura et al.

[11] 4,078,401

[45] Mar. 14, 1978

[54] METHOD AND APPARATUS FOR PROVIDING PATTERNING INSTRUCTIONS IN A KNITTING MACHINE

[75] Inventors: Shigeo Kamikura; Yutaka Kagaya; Kensuke Uemura, all of Kodaira, Japan

[73] Assignee: Silver Seiko Ltd., Tokyo, Japan

[21] Appl. No.: 799,279

[22] Filed: May 23, 1977

[30] Foreign Application Priority Data

May 28, 1976 Japan ..... 51-61069

[51] Int. Cl.[2] .....D04B 7/00; D04B 15/66

[52] U.S. Cl. .....66/75.2; 66/154 A

[58] Field of Search.....66/75.2, 66/154 A, 50 R; 340/172.5; 235/151.11

[56] References Cited

U.S. PATENT DOCUMENTS

| | | | |
|---|---|---|---|
| 3,035,426 | 3/1962 | Mac Queen | 66/75.2 |
| 3,885,405 | 5/1975 | Manfred | 66/154 A |
| 3,924,244 | 12/1975 | Seitz | 66/154 A X |
| 3,983,718 | 10/1976 | Kahan et al. | 66/75.2 |
| 3,991,592 | 11/1976 | Kahan et al. | 66/75.2 |
| 4,006,611 | 2/1977 | Kahan et al. | 66/75.2 |
| 4,015,445 | 4/1977 | Kahan et al. | 66/75.2 |
| 4,036,035 | 7/1977 | Kahan et al. | 66/75.2 |
| 4,040,277 | 8/1977 | Kahan et al. | 66/154 A |

*Primary Examiner*—Ronald Feldbaum

*Attorney, Agent, or Firm*—Lane, Aitken, Dunner & Ziems

[57] ABSTRACT

A method and apparatus for providing patterning instructions in a knitting machine by reading a program carrier and converting the readings to digital signals to be stored in a memory means. A manually operable member cooperating with the reading means allows the instructions to be recalled from memory to be selectively determined for controlling for the knitting operation.

14 Claims, 7 Drawing Figures

METHOD AND APPARATUS FOR PROVIDING PATTERNING INSTRUCTIONS IN A KNITTING MACHINE

BACKGROUND OF THE INVENTION

This invention relates to a knitting machine, and more particularly to a method and an apparatus for providing patterning instructions in such a machine.

In a knitting machine, particularly a hard-operated knitting machine having an electromechanical needle selection mechanism, a program reading device is provided for reading design instructions on a design paper or program carrier to produce electric signals for controlling the needle selection mechanism. Typically the signals thus produced are stored in a temporary electronic storage memory and recalled from memory in response to movement of the machine carriage relative to knitting needles in the needle bed. The signals thus recalled from memory are then applied to the needle selection mechanism to cause the needles to be selected in accordance with the original design instructions. In the course of knitting a fabric, typically a predetermined unit number of signals will be required to be repetitively recalled from storage so that a unit design may be repetitively produced in the horizontal direction in the fabric.

A conventional design paper has rectangles thereon arranged in rows and columns and the design instructions are placed on the design paper by selectively darkening the rectangles. The design paper typically includes design instructions constituting a unit design, which comprise a predetermined unit number of design instructions in a row. The unit number, however, is required to be selectively variable according to the particular design to be knitted. It is, therefore, necessary for a program reading device to be provided having means for specifying or determining the unit number for control of the memory.

A suitable program reading device is disclosed in U.S. patent application No. 737,433, titled "A Knitting Machine Coupled With the Program Reading Device", filed on Nov. 1, 1976. In that device the program carrier itself includes an instruction mark for specifying the unit number and the mark is detected by an electronic reading means prior to the reading of the design instructions on the program carrier. Thus, each program carrier has the appropriate unit number fixedly specified on it by a mark.

For reasons of economy, however, a single program carrier may include several unit designs not all having the same unit number. Additionally, it is sometimes desirable to reproduce repetitively only part of a unit design on a design paper in the horizontal direction in a fabric. To provide for such cases, the unit number must be specifiable independently of the program carrier itself.

SUMMARY OF THE INVENTION

Accordingly, a principal object of the present invention is to provide a new and efficient method in a knitting machine for determining the unit number for the signals to be repetitively recalled from memory, independent of the program carrier on the program reading device.

Another object of the invention is to provide in a knitting machine a program providing device for providing electric signals representative of the design instructions read by the program providing device from a program carrier wherein the unit number may be specified at any time independent of the program carrier.

Another object of the invention is to provide a program providing device wherein the unit number may be specified by a simple operation of a manually operable member.

A still further object of the invention is to provide a program providing device wherein the unit number actually specified is indicated in association with the program carrier positioned on the device to facilitate confirmation by a manual operator of the unit number at any time during knitting.

A still further object of the invention is to provide in a program providing device in a knitting machine a new and efficient method using an electronic reading means for determining the binary values representative of a row of instruction marks on the program carrier on the device.

A still further object of the invention is to provide a program providing device using an electronic reading means for providing binary signals corresponding to the presence and absence of markings on the program carrier irrespective of the material of the program carrier and the marking instrument used to mark the program carrier.

A method according to the present invention for determining the unit number for the signals to be repetitively recalled from memory comprises a single step of counting strobe pulses during a period of time commencing with the reading of a row of design instructions on a program carrier by a reading means and ending at the instant the reading means detects a specific element distinguishable from instruction elements on the program carrier.

A program providing device according to the present invention comprises a defining member disposed for displacement in parallel with rows of design instructions on a program carrier mounted on the device to indicate a particular column of design instructions on the program carrier for defining a horizontal size delineating instruction. The unit number for the design instructions to be reproduced repetitively in the horizontal direction in a fabric is specified by the number of columns in the range defined by a predetermined column and the particular column of design instructions on the program carrier. The device further includes a manually operable member for manual displacement of the defining member.

Further features and advantages of the present invention will be apparent from the following description of the preferred embodiments with reference to the accompanying drawings. It is not intended, however, that the scope of the invention be limited to specific embodiments disclosed in the drawings.

DESCRIPTION OF THE PREFERRED EMBODIMENT

Figure 1:
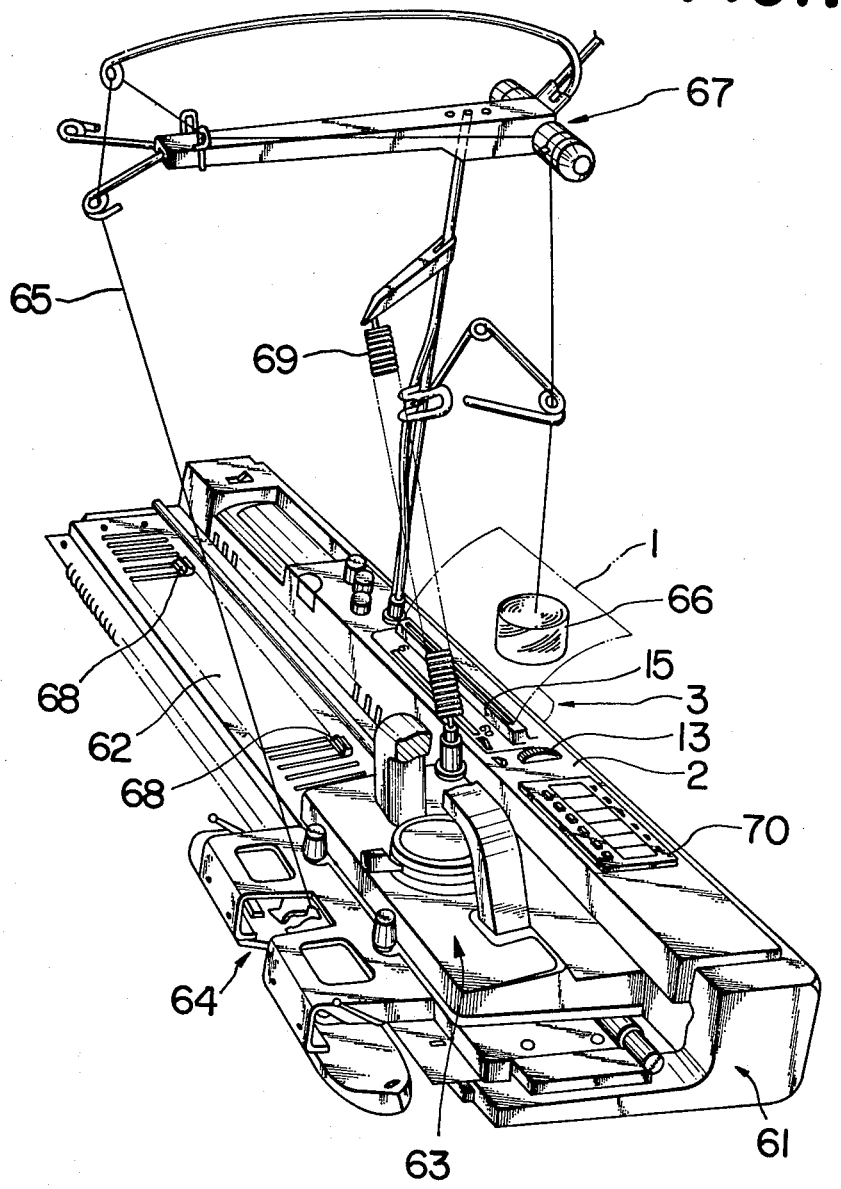
FIG. 1 is a perspective view of a hand operated knitting machine according to the invention illustrating generally the setting of the invention.

The knitting machine of FIG. 1 comprises a machine body 61 having thereon a needle bed 62. A plurality of movable knitting needles are mounted in the needle bed 62 in a side by side relation. A manually operable carriage 63 is slidably mounted on the needle bed 62 for operation of the knitting needles. The carriage 63 is provided with a yarn feeder 64 for laying or feeding a knitting yarn or yarns 65 onto the knitting needles during knitting operation. The knitting yarns 65 are supplied from yarn supplies 66 through a conventional takeup device 67 removably mounted on the machine body 61 and having takeup springs.

The carriage 63 is provided with a pair of needle selecting means (not shown) each of which comprises an electromechanical actuator means operable by a common drive circuit means for selectively operating the knitting needles. The carriage 63 is further provided with means for detecting the movement of the carriage relative to the needle bed. The detecting means including, for example, a carriage timing pulse generator, a carriage running direction detecting switch mechanism, etc., and a switch mechanism cooperating with a pair of actuator members 68. The positions selected by the operator for the actuator members 68 on the needle bed 62 defines a range in which the needle selection operation is to be effected by the needle selecting means as disclosed in U.S. Pat. application No. 737,433.

The detecting means and electromechanical actuators are electrically connected by means of a flexible multiwired cable 69 to the common drive circuit means which is provided under a cover 2 mounted on the machine body 61. The cover 2 has thereon an integral control board 70 provided with several manually operable members in the form of keys or push buttons as input means to the circuit means and with corresponding display devices as output means from the circuit means.

The machine body 61 is provided with a reading device generally designated by 3. The reading device is adapted to read the program or patterning instructions recorded on a program carrier 1 and to provide electric signals representative of the patterning instructions to the drive circuit means. The drive circuit means in turn provides drive signals to the electromechanical actuators in response to movement of the carriage 63 for selective energization for needle selection in correspondence with the signals provided by the reading device 3.

Figure 2:
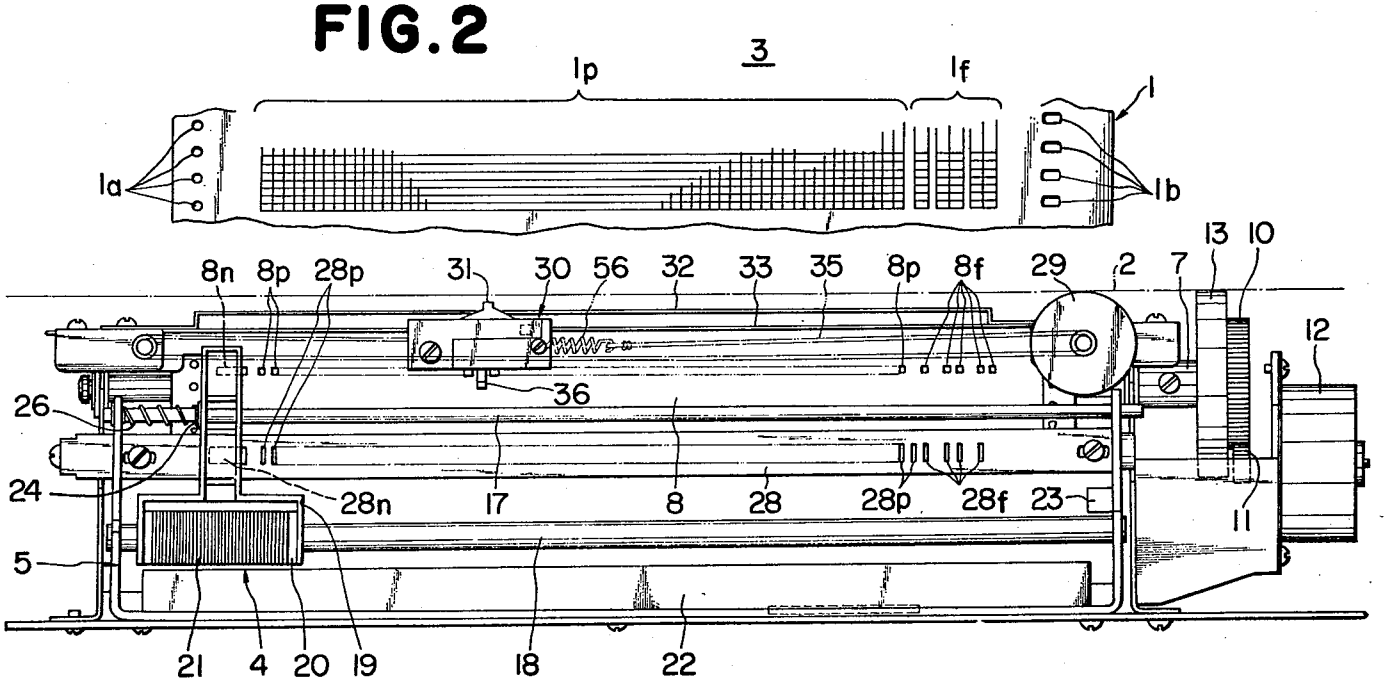
FIG. 2 is an elevational view showing in detail a reading device and program carrier or card according to the invention.
Figure 3:
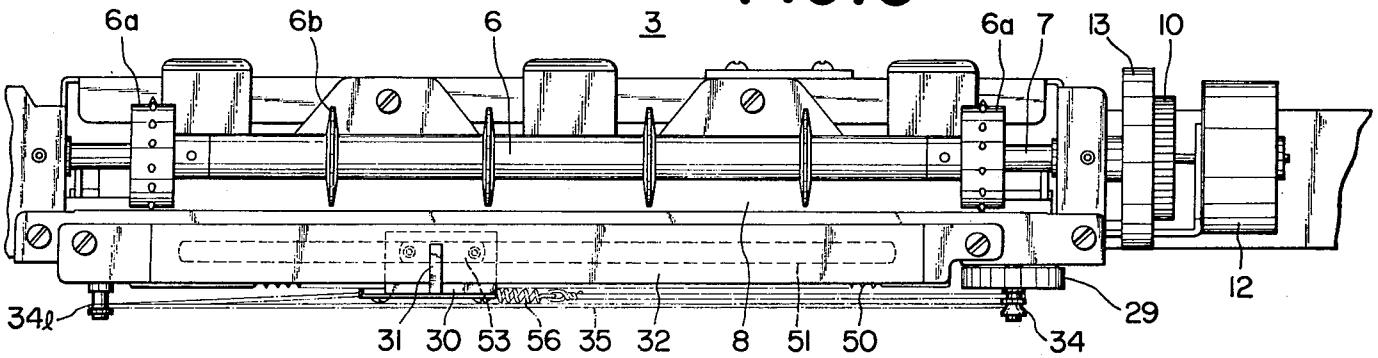
FIG. 3 is a plan view of the reading device of FIG. 2.

Referring to FIGS. 2–5, the reading device 3 is mounted on the machine body 61, including a frame 5 (actually comprising several elements) disposed under the cover 2. A shaft 7 having a feed roller 6 affixed thereto which includes a pair of sprocket wheels **6*a* for feeding the program card 1 in one or the other direction in cooperation with a pair of rows of perforations 1*a* and 1*b* formed in the card 1 is rotorably mounted in the frame 5. As shown in FIG. 3, four discs 6*b* are also provided on the feed roller 6 between the sprockets 6*a* for holding the program card 1** in a semicylindrical state.

Figure 4:
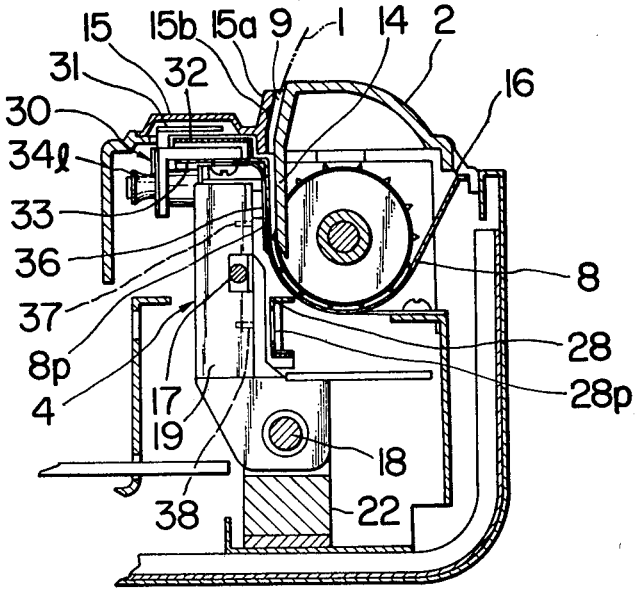
FIG. 4 is a sectional view showing additional construction details for the reading device.
Figure 5:
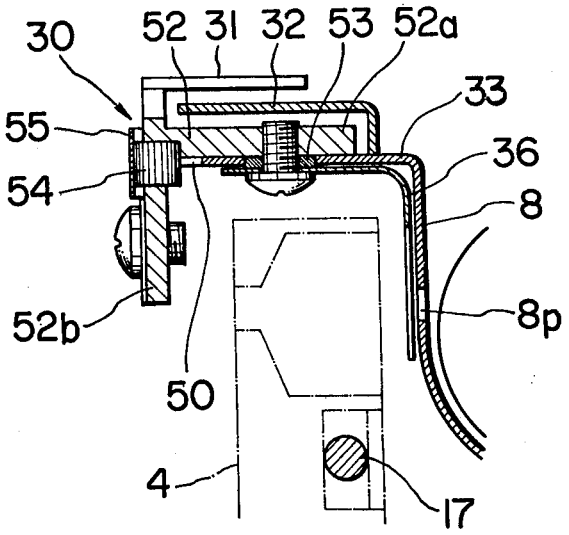
FIG. 5 is an enlarged sectional view taken as in FIG. 4 showing further construction details of a defining member.

A guide plate 8 in FIG. 4 having a nearly U-shaped cross-section is mounted on the machine body for allowing contact of the program card 1 with the feed roller 6 for guiding the program card 1 from an elongated front opening or entrance slot 9 defined by the cover 2 and an upper plate 15 mounted on the cover 2 to another elongated rear opening or exit slot 16 formed between the cover 2 and the machine body 61 while the program card 1 passes over a scanning line of a scanning sensor 37 and further passes through the under face of the feed roller 6 along the lower circular portions of the disks **6*b* of the feed roller 6, or vice versa. The cover 2 is provided with five vertical hanging portions 14 in FIG. 4 between each sprocket wheel 6*a* and an adjacent disk 6*b* and also between the adjacent disks 6*b* for holding the card 1 inserted from the entrance slot 9 against the rear (right hand side in FIG. 4) face thereof to support it in a flattened state along the scanning line. The upper plate 15 is provided in the rear (right hand side in FIG. 4) side thereof with an upright portion 15*a* extending alongside the entrance slot 9. The upper plate 15 is made of a transparent material such as a transparent plastic material to allow direct observation of the program card 1 inserted from the entrance 9 through the upright portion 15*a* of the upper plate 15. A colored reference line 15*b* in FIG. 4 is provided on the upright portion 15*a* for appropriate positioning of the program card 1**.

The feed roller 6 is adapted to be incrementally rotated in one or the other direction by means of a bidirectional stepping motor 12 cooperating through a gearing connection comprising gears 10 and 11. The gears 10 and 11 are mounted on the shaft 7 of the feed roller 6 and the output shaft of the stepping motor 12, respectively, and the stepping motor 12 is mounted on the frame 5.

A thumb wheel 13 is exposed to the exterior of the machine through a window of the cover 2. Wheel 13 is mounted on the shaft 7 of the feed roller 6 to permit the manual operator to manually incrementally feed the card 1.

The program card 1 in FIG. 2 together with the reading means is used to instruct or program the circuit means, which may include a microcomputer means, to control the manner in which fabric is knitted. As shown in FIG. 2, the card 1 includes, between a pair of rows of perforations **1*a* and 1*b*, mutually perpendicular lines which define a design area 1*p* of rectangles which extend in columns and rows. The rectangles in the design area 1*p*** correspond to stitches and the columns and rows to wales and courses, respectively, which may be knitted in a fabric in accordance with instructions on the card. Preferably the width and height of each rectangle is such as to substantially correspond to the width and height of a typical stitch.

The card 1 further includes, between the design area **1*p* and the right-hand side row of perforations 1*b*, a function area 1*f* which involves one independent and two paired columns of rectangles aligned with the rows of rectangles in the design area 1*p*. In a preferred embodiment the columns in the function area 1*f* are provided for operation of the output elements of the circuit means. For example, the independent column controls the action of an alarm device and one pair of the columns relates to the designation of the feeding direction of the program card 1 itself. One column of the other pair relates to successive feeding or jumping of the card 1 and the other column relates to stopping in such successive feeding. The alarm device may be employed by the machine operator, for example, for detecting the instant when a given knitting yarn 65** is changed to another knitting yarn having a different color.

The reading device 3 further includes a scanning member 4 which is slidably mounted on a pair of upper and lower guide rods 17 and 18 mounted on the frame 5 in parallel with the shaft 7 of the feed roller 6.

A transverse slot provided in a running body 19 of the scanning member 4 is slidably met with the upper guide rod 17, while a bobbin 20 affixed to the running member 19 is slidably met with the lower guide rod 18. A coil 21 is wound around the bobbin 20. Disposed in a position below the lower guide rod 18 and fixedly mounted on the frame 5 in parallel with the guide rod 18, is an elongated permanent magnet 22 constituting a linear motor cooperative with the coil 21. Different magnetic poles are provided for the upper and lower portions of the permanent magnet 22 respectively, and the lower guide rod 18 and at least part of the frame 5 are preferably made of any magnetic material to form a desired magnetic path. During operation, the application of current to the coil 21 causes the scanning member 4 to be traversed along the length of the guide rods 17 and 18 in response to the direction of the current flowing through the coil 21.

The scanning member 4 is normally positioned at the left stroke end in the position shown in FIG. 2 and is moved from the left to the right stroke end and subsequently returned to the original left stroke end from the right in response to the directional movement of the carriage 63. The reciprocating movement of the scanning member 4 is typically accomplished in a continuous cycle without any dwelling.

A limit switch 23 is appropriately positioned relative to the right stroke end of the scanning member 4 and a stop 24 is attached to the upper guide rod 17 in a position corresponding to the left stroke end of the scanning member 4. The guide rod 17 is preferably movably mounted on the frame 5 so as to be movable a predetermined distance in the longitudinal direction relative to the frame 5, and to be urged to the right direction by a spring buffer 26 at the left end portion of the rod 17. During operation the spring 26 protects or relieves the scanning member 4 from shock at the left stroke end when the scanning member 4 comes into colliding contact with the stop 24 during return movement to the left.

A photoelectronical sensor 37 including a light emitting element and a photoelectrical transducer to convert the light reflected from the surface of the program card 1 to an electric signal is disposed at a right hand side portion of the scanning member 4 as shown in FIG. 4. The sensor 37, hereinafter referred to as the "scanning sensor" is adapted to scan the program card 1 along the predetermined scanning line.

In order to properly expose the program card 1 on the feed roller 6 to the scanning sensor 37, the card guide plate 8 is provided along the scanning line of the scanning sensor 37 with slits **8*p* which correspond to the columns in the design area 1*p* of the program card and also with slits 8*f* which correspond to the columns in the function area 1*f*. The slits 8*p* and 8*f* of FIG. 2** could also be formed as one or several elongated holes.

In order to enable the scanning sensor 37 to read an unmarked portion of the program carrier 1 at the start of a scan by the scanning member 4, the card guide plate 8 is formed with a further slit **8*n* which is disposed at the left of and in line with the row of slits 8*p* and 8*f* so that the scanning sensor 37 in the original position can read the blank or unmarked area specially provided at the left outside of the design area 8*p* on the program carrier 1**.

A horizontally extending linear encoder 28 in the form of an elongated plate is mounted on the frame 5 in parallel with the guide rods 17 and 18 in a position below the scanning line in the rear (right as viewed in FIG. 4) side of the scanning member 4. The linear encoder 28 has slits **28*p* and 28*f* formed thereon corresponding, respectively, to the columns in the design area 1*p* and function area 1*f* on the program card 1. It is to be understood that the width of each of the slits 28*f* and 28*p* may be formed less than the width of the corresponding slits 8*f* and 8*p* provided in the card guide plate 8**.

A similar photoelectronic sensor, including a sampling pulse generator 38 is attached in the scanning member 4 for photoelectronically reading the slits **28*p* and 28*f*. This sensor includes a light emitting element for irradiation of light onto the front face of the linear encoder 28 and a photoelectric transducer for converting the light reflected from the encoder to an electric signal. The sampling pulse generator 38 is adapted to produce pulses corresponding to the slits 28*p* and 28*f* as the scanning member 4 traverses along a row of rectangles over the design and function areas 1*p* and 1*f* on the program card 1. The pulses thus obtained are used to sample the output of the scanning sensor 37 to produce corresponding signals representative of the design or function instructions marked in the rectangles included in the corresponding row. Thus, the slits 28*p* and 28*f* of the linear encoder 28** function as the so-called "strobe marks", and the signals are temporarily stored in a memory in the circuit.

Marks in the design area **1*p* of the program card 1 define the pattern to be knitted. Marks in the function area 1*f* may also define a pattern to be knitted such as providing for vertical repeat imaging or a vertical mirror repeat imaging of a unit design. The boundaries for a unit design area to be repetitively reproduced in a fabric must be selected or specified by the machine operator, and the boundaries in the vertical or feeding direction of the program card 1 will be specified by selectively darkening rectangles in one or both of the pairs of the columns in the function area 1*f*** while the boundaries in the horizontal direction will be specified by means of a size delineating means which will be described in detail.

Referring now to FIGS. 2–5, an extension 33 extending horizontally and adjacent to the upper plate 15 is formed in the front (as viewed in FIG. 4) portion of the guide plate 8. Notches 50 are formed in the extension 33 corresponding to the slits **8*p* and an elongated hole 51 disposed in parallel with the scanning line in the intermediate position of the extension 33**.

A movable defining member designated generally by the numeral 30 is slidably mounted on the extension 33, and includes a body 52 comprising a horizontal portion **52*a* and vertical portion 52*b*. A spacer 53 engaged in the elongated hole 51 to guide the movable head 30 along the hole 51, and a metallic reflective plate 36 disposed in the opposite side of the extension 33 for restraining the vertical movement of the head 30, are fastened in a lamination by a set screw on the horizontal portion 52*a*** of the body 52. A hole is provided in the vertical portion 52*b* of the body 52 to provide for mounting a detent roller 54 for engagement with a notched portion of the extension 33. The detent roller 54 is urged against the notched position of the extension 33 by a leaf spring 55 fixed to the front of the vertical portion 52*b*.

A manually operable thumb wheel 29 is rotatably mounted on the frame 5 in the vicinity of the right end of the extension 33 for moving the defining member 30 along the length of the knitting machine. The upper portion of the thumb wheel 29 is exposed to the exterior through a window opening formed in the cover 2. The thumb wheel 29 has a pulley 34*r* integrated therewith. A cord 35 connected to said defining member 30 is extended between the pulley 34*r* and another pulley 34*l* rotatably mounted on the frame 5 in the vicinity of the left end of a extension 33. The cord 35 has one end fixedly connected to the member 30 and the other end connected to one end of a takeup coil spring 56. The other end of spring 56 is connected to the member 30. In order to permit movement of the movable head 30 to the right or left direction as viewed in FIG. 2 or 3 as the wheel 29 is manually rotated, the cord 35 is wound in several rolls around the pulley 34*r* and the tension of the coil spring 56 is chosen so that spring 56 provides sufficient friction between the pulley 34*r* and the cord 35 to move the defining member 30 in response to manual rotation of the wheel 29.

The reflective plate 36 mounted on the body 52 of the defining member 30 has a vertical portion extending downwardly beyond the slits 8*p* on the guide plate 8 and is disposed adjacent to said guide plate 8. The surface of the vertical portion (the left hand side surface as viewed in FIG. 4) is formed as a mirror to enhance the reflection of the light. The vertical portion has a width sufficient to cover or shut one slit 8*p* on the card guide plate 8.

A scale 32 having graduations aligned with the columns in the design area 1*p* of the program card 1 and several numbers indicative of the numerals corresponding to the number of columns numbered from the leftmost column as viewed in FIG. 2 is disposed between the upper plate 15 and extension 33. The defining member 30 includes a pointer 31 integrated with the body 52 for indicating the graduation on the scale 32. With this arrangement, the indicator including the pointer 31 and scale 32 indicates the column in the design area 1*p* on the program card 1 corresponding to the slit 8*p* on the guide plate 8 covered by the reflective plate 36.

The design column on the card 1 indicated by the indicator is used to specify the right hand boundary column while the left hand boundary column is always specified by the leftmost design column of the card 1. Accordingly, the size of the desired unit design in the horizontal direction is specified by the number of the columns included between the left and right hand boundary columns inclusive, the number being indicated by the indicator means as described above. As a result of this arrangement, the size of the unit design in the horizontal direction may be specified and selected by manual operation of the thumb wheel 29 by the machine operator.

As previously mentioned, the front face of the reflective plate 36 is formed as a mirror having a relatively high reflectivity factor for light as compared with either the front face of the guide plate 8 which is typically colored in black for minimizing reflection of light or the surface of the card 1. Due to this arrangement the output voltage from the scanning sensor 37 is rapidly raised, when the scanning sensor 37 comes to a position opposed to the reflective plate 36, to a level considerably higher than the output voltage otherwise resulting when reading a marked or unmarked instruction on the program carrier. A comparator means is provided for comparing the output of the scanning sensor 37 with an appropriate reference voltage to detect when the sensor 37 is in a position opposed to the reflective plate 36. The appropriate reference voltage may be readily determined by experiment and has a level intermediate between the aforementioned level and any other highest level when the sensor 37 reads other than the reflective plate 36.

Figure 6:
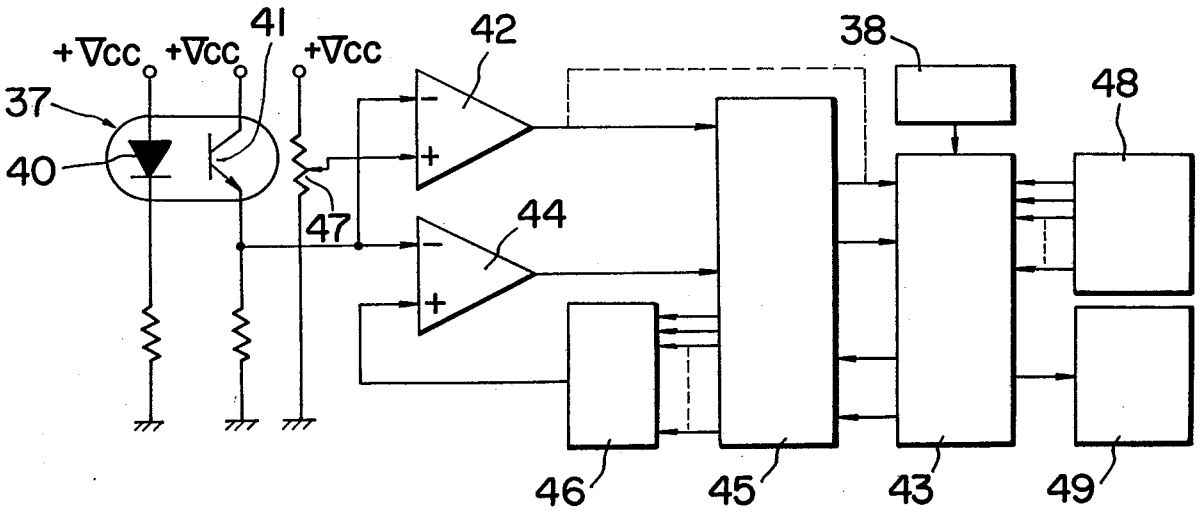
FIG. 6 is a partial schematic, partial block diagram of an electronic circuit according to the method and apparatus of the invention.

For this purpose an analog comparator 42 compares the output voltage from the photoelectric transducer 41 of the scanning sensor 37 with the reference voltage determined by experiment and provided by a variable resistor 47. The scanning sensor 37 as shown in FIG. 6 has a light emitting element 40 and a photo electric transducer 41. The output of the comparator 42 is a binary signal which is normally a high voltage but which becomes a low voltage when the scanning sensor 37 detects the reflective plate 36.

The output of the sampling pulse generator 38 is connected to a similar comparator, the output of which is, in turn, connected to a control circuit 43. The output pulses of this comparator(which is included in the pulse generator 38 in FIG. 6) are sequentially counted by a counter provided in the circuit 43 from the start of a scan by the scanning member 4. The counter is typically cleared immediately prior to the start of a count.

The counting operation of the counter is suspended from counting when a low voltage as mentioned above is supplied from the comparator, and such counting value is stored in a memory included in the control circuit 43. Thus, a preset needle selecting unit number may be stored in the memory in the form of an electric digital signal by controlling the pointer 31 based on the graduations on the scale 32 by turning the thumb wheel 29 as mentioned above.

The control circuit 43 includes a memory for storing the binary signals derived from reading the knitting pattern, and the electric binary signals stored in memory may be repeatedly read out in order according to the number of bits corresponding to the counter values stored in the memory. Then as the carriage 63 traverses the needle bed, appropriate needle selection will be accomplished by a needle selecting device 49 including the previously described electromechanical actuators.

In FIG. 6, all the input devices other than the scanning sensor 37 and sampling pulse generator 38 are illustrated as being included in a block 48 wherein are provided as mentioned above, a carriage timing pulse generator, switch mechanisms for detecting the carriage running direction and needle selection range, the input means provided on the control board 70 on the cover 2, and any other input means of the knitting machine.

The circuit of FIG. 6 is also provided with a means for finally determining the binary "1" or "0" value of an electric signal corresponding to the presence or the absence of the markings. This result is achieved due to the fact that the reflectivity factor for light depends upon the type of marking material used for providing markings on the card 1 and the type of material constituting the card. For example, if conventional white paper is used for the card material, a ratio of the reflectivity factor of light in a blanking area to an area preprinted with black ink is approximately 3 through 7 to 1. Accordingly, the reflectivity factor of light in the marked area is considerably less than that in an unmarked or blanking area. On the other hand, when a transparent or translucent material obtained by mat-finishing (i.e. creating very slight unevenness by a mechanical or chemical process in one or both faces of a film) plastic film such as a polyestate resin film is used for the card material, the design area may be marked in black with a pencil by the operator. In this case, the ratio of the reflectivity factor of light of the blanking area to the black penciled area is approximately 1 to 2 through 4. Accordingly, the marked area has a considerably high reflectivity factor compared with the blanking area. It may be understood with the foregoing experimental data that the white paper has an inverse reflectivity relationship as compared to the film material with reference to the reflectivity factor of light. Nevertheless, the electric binary "1" or "0" signal must be determined depending on the presence or the absence of the markings.

To overcome this problem, the circuit in FIG. 6 is provided with another analog comparator 44, a digital to analog converter 46, and an operation circuit including a memory in logic circuit 45 for controlling the comparator 44 and converter 46. Operation of this circuit means will now be described.

A start signal for triggering the linear motor is initially applied from the control circuit 43 to the logic circuit 45 at the beginning of a scan by the scanning member 4. The operation circuit is adapted to control the converter 46 to detect the output voltage of the scanning sensor 37 at the beginning of a scan. As a result, a digital voltage signal is obtained corresponding to the sensor 37 output voltage corresponding to a reading of the blanking area of the program card 1. Subsequently, a value is added to and subtracted from the digital voltage signal to obtain a first and a second reference digital voltage signal, respectively. The value added or subtracted corresponds to an appropriate voltage at the input of the comparator 44 which has been predetermined by experiment. Next, a scan of the program carrier 1 by the scanning member 4 is started. During the scan, the operation circuit provides an output for each strobe pulse applied from the pulse generator 38 through the control circuit. The operation circuit output is alternatively provided successively to the converter 46 to produce the first and then the second reference digital voltage signals for successive paired comparisons with the output of the scanning sensor 37. The results of the successive comparisons are then compared with each other in the operation circuit to obtain a final result in the form of a binary value "1" or "0" representing a design or function instruction in a rectangle on the program carrier 1 as read by the reading member 37. The resulting ones and zeros correspond to markings and lack of markings, respectively, on the program card 1. The effectiveness of the circuit depends upon the output of the sensor 37 being a value intermediate between the first and second reference voltages when reading an unmarked area, and upon the results of the first comparison being outside of the range between the two reference voltages, regardless of whether higher or lower than either such reference voltage when reading a marked area. The binary signals obtained as a result of the second comparison are individually stored in a memory means as instruction signals, each being representative of a design or function instruction. The stored instruction signals are thereafter recalled from memory as required.

Meanwhile, during a scan the column counter counts the strobe pulses (up to "64") corresponding to the total number of slits 28*p* and 28*f* when the scanning member 4 arrives at the right stroke end. The scanning member 4 is then immediately actuated to move leftwardly to return to its original starting position except when a marking for a jump or successive feed is detected. In such event, the scanning member 4 is stopped at the right stroke end such that the scanning sensor is then opposite to the rightmost column on the program carrier. The stepping motor 12 is then immediately energized to feed the program carrier 1. The feeding of the program carrier 1 continues until the scanning sensor 37 detects a marking in said rightmost "stop" column. At such time the scanning member 4 is caused to return to its original starting position. During the return stroke, the circuit 45 disregards any readings by the sensor 37.

The operation of the reading device 3 as just described is effected continuously except when a needle selecting operation is required by the electromechanical needle selection mechanism on the carriage. For example, a scan is started at a suitable point in time when the carriage is positioned outside the range defined by a pair of actuator members 68 placed on the needle bed 2. Such a point in time may be, for example, at an instant when the carriage has just passed the actuator members 68 on the needle bed for given direction of carriage travel and is then outside the range defined by the actuator members 68.

Figure 7:
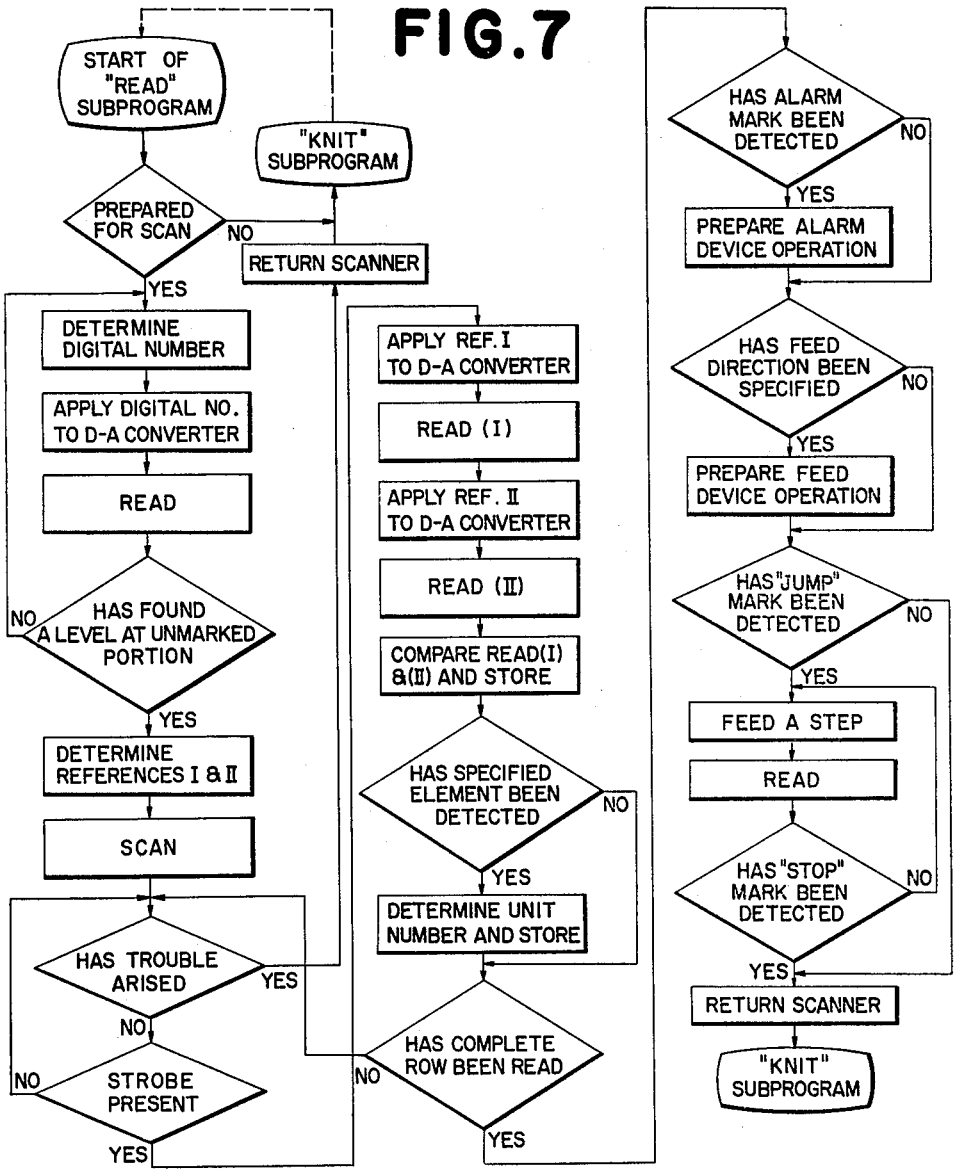
FIG. 7 is a flow diagram according to the method and apparatus of the invention.

In FIG. 6 the circuit means is illustrated as including two circuits, namely the control circuit 43 and the logic circuit 45. However, the two circuits may actually be implemented as a single chip of LSI constituting as a mini- or microcomputer having a stored program control and/or hard-wired logic circuitry. In a preferred embodiment, the program control for such a computer implementation for control of the overall patterning mechanism comprises a program including an "initialization", a "read" and a "knit" subprogram. Shown in FIG. 7 is a flow diagram for the "read" subprogram illustrating the previously described operations of the circuits 43 and 45. The descriptions of the other subprograms are omitted in the accompanying drawings as outside the scope of the present invention.

In order to facilitate discrimination by the computer means of whether or not the scanning member 4 is actually positioned in its original starting position at the start of a scan, the linear encoder 28 is provided with a further slit 28*n* formed horizontally and longer than any of the other slits 28*p* or 28*f*. The slit 28*n* is disposed to be detected by the pulse generator 38 when the scanning member 4 begins a scan from the original starting position, while the linear encoder 28 has a reflective surface in regard to the right stroke end of the scanning member 4. At the start of a scan, the computer means discriminates that the scanner 4 is not positioned in the original starting position if the output of the pulse generator 38 (or more particularly, the output of the analog comparator therein) is a high level or logical "1". In such case, the scanner 4 is actuated to return to the original leftmost position. The stored program also contains means to control the circuitry to detect if the scanner 4 has been caused to stop due, for example, to trouble (e.g. binding) during a scan. This is achieved with a timer counter for determining the time interval between two successive strobe pulses provided by the pulse generator 38. If the time interval reaches or exceeds a predetermined length of time, the computer means discriminates that trouble has arisen in the reading device 3, whereupon the scanner 4 is actuated to return to the original starting position.

What is claimed is:

1. In a knitting machine having an electromechanical needle selection mechanism, a memory means for temporary storage of signals for controlling said mechanism, and a reading device for reading design instructions on a patterning program carrier and providing signals representative of such instructions to said memory means, said reading device including a scanning member having thereon a reading member for reading the design instructions during a scan by said scanning member, and means for providing strobe pulses during such scan, the method of determining the unit number of signals to be repetitively read out of said memory means comprising:

counting strobe pulses during a time interval beginning with the start of a scan and ending when said reading member detects a specific element distinguishable from any instruction on said program carrier.

2. In an apparatus for providing electric signals representative of patterning instructions in a knitting machine having a reader for reading a program carrier which includes instruction marks in rows and columns and also an unmarked area, the reader including an electronic member disposed to read an unmarked portion of the carrier and thereafter a row of instruction marks in line with an unmarked portion and also including strobe means for providing strobe pulses during reading by the electronic member of such a row of instruction marks, the method of determining binary values corresponding to instruction marks in a row on the program carrier based upon readings by the electronic member comprising the steps of:

producing and storing first and second digital signals in response to the reading of an unmarked portion;

producing first and second thresholds corresponding to the first and second digital signals, respectively;

making a first comparison of the reading of an instruction mark in a row of instruction marks in line with the unmarked portion with the first threshold and also with the second threshold; and making a second comparison between the set of results obtained in the first comparison step.

3. In an apparatus for providing electric signals representative of patterning instructions in a knitting machine having a support for supporting a program carrier having design instructions in rows and columns thereon, and having an electronic reading member adapted to read a row of design instructions on a program carrier on the support, and having a strobe means for providing strobe pulses during such reading, the improvement comprising:

a defining member disposed for displacment in parallel with the rows of design instructions to indicate a particular column of design instructions for prescribing a horizontal size delineating instruction for a horizontally repetitively reproducible unit area of fabric including the design instructions between a predetermined column and said particular column on the program carrier; and a manually operable member operatively connected to said defining member and manually operable to displace the latter to selectively position it relative to columns of design instructions on the program carrier.

4. The improvement described in claim 3 further comprising means for detecting the number of the columns existing inclusively between said predetermined column and said particular column on the program carrier.

5. The improvement described in claim 3 further comprising:

a specific element distinguishable at the reading member from any instruction on the program carrier and disposed on the defining member such that it is detected by the reading member during reading of the program carrier; and means for counting strobe pulses during an interval of time beginning with the start of a reading and ending when the reading member detects said specific element on the defining member.

6. The improvement as described in claim 5 wherein said specific element is a mirror having a significant reflection compared with any portion of the program carrier and is photoelectronically scanned by the reading member.

7. The improvement as described in claim 6 further comprising:

an analog comparator having a first input connected to an output of the reading member; and means for providing a predetermined threshold setting to the second input of said comparator, said threshold setting being a value intermediate between the output of the reading member when reading any design instruction on the program carrier and when reading said specific element on said defining member.

8. The improvement as described in claim 7 wherein the predetermined old setting is manually adjustable.

9. The improvement as described in claim 3 wherein said manually operable member is a manually rotatable dial, and further comprising a cord means for connection between said defining member and said dial, and a pair of pulleys positioned for stretching said cord means over the length of a row of design instructions, one of said pulleys being fixed on and integral with said dial.

10. The improvement as described in claim 9 wherein said cord means includes a tension spring for taking up slack in said cord member.

11. The improvement as defined in claim 3 further comprising means for providing notches corresponding to columns of design instructions of the program carrier on the support, and a detent member provided on said defining member for engagement with said notches to position said defining member.

12. In an apparatus for providing electric signals representative of patterning instructions in a knitting machine having a reader for reading a program carrier which includes instruction marks in rows and columns and also an unmarked area, the reader including an electronic member disposed to read an unmarked portion of the carrier and thereafter a row of instruction marks in line with such unmarked portion, the improvement comprising:

means for producing first and second digital signal in response to the reading of an unmarked portion of the carrier and for storing such signals to enable subsequent successive comparisons to be made between the reading by the electronic member of instruction marks in alignment with an unmarked portion with a first and with a second threshold corresponding to said first and second digital signals, respectively.

13. The improvement as described in claim 12 wherein the producing and storing means includes a digital-to-analog converter, an analog comparator having a first input connected to the electronic member and having a second input connected to the output of said converter, and means connected to the output of said comparator for providing successive digital signals to said converter to produce a digital signal corresponding to the reading by the electronic member of an unmarked portion of the program carrier.

14. The improvement as described in claim 12 wherein said producing and storing means includes a digital-to-analog converter, an analog comparator having a first input connected to the electronic member and a second input connected to the output of said converter, and means connected to the output of said comparator and to the inputs of said converter for producing a digital signal corresponding to the reading by the electronic member of an unmarked portion of the program carrier and for determining said first and second digital signals from said digital signal.

* * * * *